US006988676B2

(12) United States Patent
Schreur et al.

(10) Patent No.: US 6,988,676 B2
(45) Date of Patent: Jan. 24, 2006

(54) TURBINE DRIVE ROTARY SPRAY CLEANER

(75) Inventors: Ivan Schreur, Piqua, OH (US); Doug Shawver, Tipp City, OH (US); Dan O'Brien, Piqua, OH (US)

(73) Assignee: Crane Pumps & Systems, Inc., Piqua, OH (US)

( * ) Notice: Subject to any disclaimer, the term of this patent is extended or adjusted under 35 U.S.C. 154(b) by 456 days.

(21) Appl. No.: 10/203,867

(22) PCT Filed: Mar. 13, 2001

(86) PCT No.: PCT/US01/07886

§ 371 (c)(1),
(2), (4) Date: Aug. 14, 2001

(87) PCT Pub. No.: WO01/68264

PCT Pub. Date: Sep. 20, 2001

(65) Prior Publication Data

US 2003/0015603 A1 Jan. 23, 2003

Related U.S. Application Data

(60) Provisional application No. 60/189,195, filed on Mar. 14, 2000.

(51) Int. Cl.

| | |
|---|---|
| ***B05B 1/34*** | (2006.01) |
| ***B05B 3/04*** | (2006.01) |
| ***B05B 3/16*** | (2006.01) |

(52) U.S. Cl. ..... 239/380; 239/381; 239/382; 239/383; 239/225.1

(58) Field of Classification Search ..... 239/380, 239/381, 382, 383, 389, 225.1, 227, 233, 239/230, 240, 241, 243

See application file for complete search history.

(56) References Cited

U.S. PATENT DOCUMENTS

| | | | | | |
|---|---|---|---|---|---|
| 4,081,138 | A | | 3/1978 | Behr | |
| 4,405,087 | A | | 9/1983 | Mata-Garza | |
| 4,407,678 | A | | 10/1983 | Furness et al. | |
| 4,828,179 | A | | 5/1989 | Garner | |
| 4,986,476 | A | * | 1/1991 | Hour | 239/227 |
| 5,104,043 | A | * | 4/1992 | Pacht | 239/128 |
| 5,169,069 | A | * | 12/1992 | Rucker et al. | 239/227 |
| 6,123,271 | A | * | 9/2000 | Delaney et al. | 239/227 |

* cited by examiner

*Primary Examiner*—Davis Hwu

(74) *Attorney, Agent, or Firm*—Standley Law Group LLP

(57) ABSTRACT

A spray cleaner (10) is provided for rotatingly cleaning an interior of a vessel or the like. The spray cleaner has a main body (12) and a rotating spray body (14). The main body is at a proximal end of the spray cleaner, and the rotating spray body is at a distal end of the spray cleaner. An internal flow conduit (22) in the main body of the rotating spray body communicates a fluid inlet in the main body to a plurality of spray nozzles (18) in at least one spray head which is a part of the rotating spray body. A drive train (30) for rotating the spray body is positioned in the main body, such that the flow conduit passes around the drive train in an annular passage coaxial with the drive train, providing cooling thereto. A vaned rotor (26) in the flow conduit is connected to an input shaft (28) of the drive train, which transfers torque to an output drive system (42) that is fixedly connected to the rotating spray body. The rotation of the rotating spray body relative to the main body about a longitudinal axis of the cleaner effects rotation of the at least one spray head about a radial axis of the cleaner. A planetary gear set (36) may be used as the drive train.

23 Claims, 3 Drawing Sheets

TURBINE DRIVE ROTARY SPRAY CLEANER

This application claims the benefit of provisional application No. 60/189,195, filed Mar. 14, 2000.

The present invention relates to improvements for a rotary spray cleaner having a plurality of spray nozzles, especially a rotary spray cleaner which would be used in cleaning the interior of a vessel. Particular aspects of the invention which are disclosed include a planetary gear drive for speed reduction and an interchangeable orifice portion for modifying fluid flow immediately prior to an impeller for generating torque and speed to be transferred to the planetary gear drive, where the speed is reduced and rotation of the spray nozzles is accomplished.

BACKGROUND OF THE ART

The concept of using pressurized cleaning fluid to provide the motive power for rotating a rotary spray cleaner is well known. A variety of different gear arrangements to accomplish this have been provided in the prior art. A particularly desirable goal in designing these spray cleaners is to make them small enough so that they can be inserted into the smaller access ports in the vessel to be cleaned. These access ports are usually about three inches in diameter in a tank car having compartments. Some solutions have even located the motive power source external to the vessel.

A continuing concern with using the pressurized fluid to provide the motive power is that the pressure required to be maintained for effective cleaning is so great that the rotational speed will be too fast. While gear reduction, even through the use of planetary gear drives, has been used, the gear box employed must be sufficiently shielded from the pressurized fluid, which may be caustic or corrosive, that rotational speed of the nozzles may be effectively changed only be changing fluid pressure or flow.

The long-felt need of the market, therefore, is for a compact rotary spray cleaner with significant gear reduction, but also with a generally accessible means being provided for additional interchangeable adjustment of the rotational speed of the nozzles.

One such attempt in the prior art is illustrated by U.S. Pat. No. 5,954,271, to Le. This patent goes to great lengths to isolate the gear drive so that it is not located between the fluid inlet and the nozzles, but is instead distal to the nozzles. This means that there is no ability to adjust rotational rate, and the gear drive is not easily interchanged in any case. Part of the reason why the gear drive is difficult to change is that it is positioned distal to the spray head.

It is therefore, an advantage of the present invention to provide a compact rotary spray cleaner which may be inserted into access ports no greater than three inches in diameter, use the pressurized cleaning fluid to provide motive power to rotate the nozzles through which the fluid exits the cleaner, and in which the rotational speed of the nozzles may be adjusted by a readily accessible means other than the pressure of the cleaning fluid.

SUMMARY OF THE INVENTION

This and other advantages are provided by a rotary spray cleaner comprising a main body, and a rotating spray body, with an internal flow conduit in the main body and the rotating spray body. The main body, which has a fluid inlet, is located at the proximal end of the spray cleaner. The rotating spray body is located at the distal end of the spray cleaner, and it further comprises at least one spray head, with each of the spray heads having a plurality of spray nozzles. The internal flow conduit communicates the fluid inlet to each said spray nozzle.

The main body further comprises a drive train, and the flow conduit in the main body passes around the drive train in an annular passage. In at least one embodiment, this annular passage is coaxial with the drive train in the main body.

In at least one embodiment, a vaned rotor in the flow conduit is connected to an input shaft of the drive train, which comprises a planetary gear set in which torque from the input shaft is transferred at a reduced speed to a output drive system that is fixedly connected to the rotating spray body so that rotation of the rotating spray body relative to the main body about a longitudinal axis of the cleaner effects rotation of the at least one spray head about a radial axis of the cleaner. In such an embodiment, a first bevel gear fixed to the main body meshes with at least one second bevel gear, with one of such second bevel gears fixed to the at least one spray head, resulting in spray head rotation as the spray body rotates relative to the main body.

In at least one embodiment of the invention, a removable orifice portion is positioned in the flow conduit between the fluid inlet and the vaned rotor. This orifice portion comprises a flow divider and a stator, especially a flow divider having a conate projection that extends in to the flow conduit to reduce flow area. The flow divider further has a plurality of openings to further reduce flow area, with each of the plurality of openings in the flow divider being radially offset from an axis of the flow divider, inducing a radial component to flow velocity. Typically, the stator is positioned after the flow divider in the orifice portion and has a plurality of openings therein. In many embodiments, the total cross-sectional area of the stator openings is smaller than a total cross-sectional area of the flow divider openings and the stator openings are positioned to direct fluid flowing in the flow conduit at an angle relative to the vaned rotor.

BRIEF DESCRIPTION OF THE DRAWINGS

Better understanding of the present invention will be had when reference is made to the accompanying drawings, wherein identical parts are identified by identical reference numerals and wherein.

DETAILED DESCRIPTION OF THE INVENTION

Figure 1:
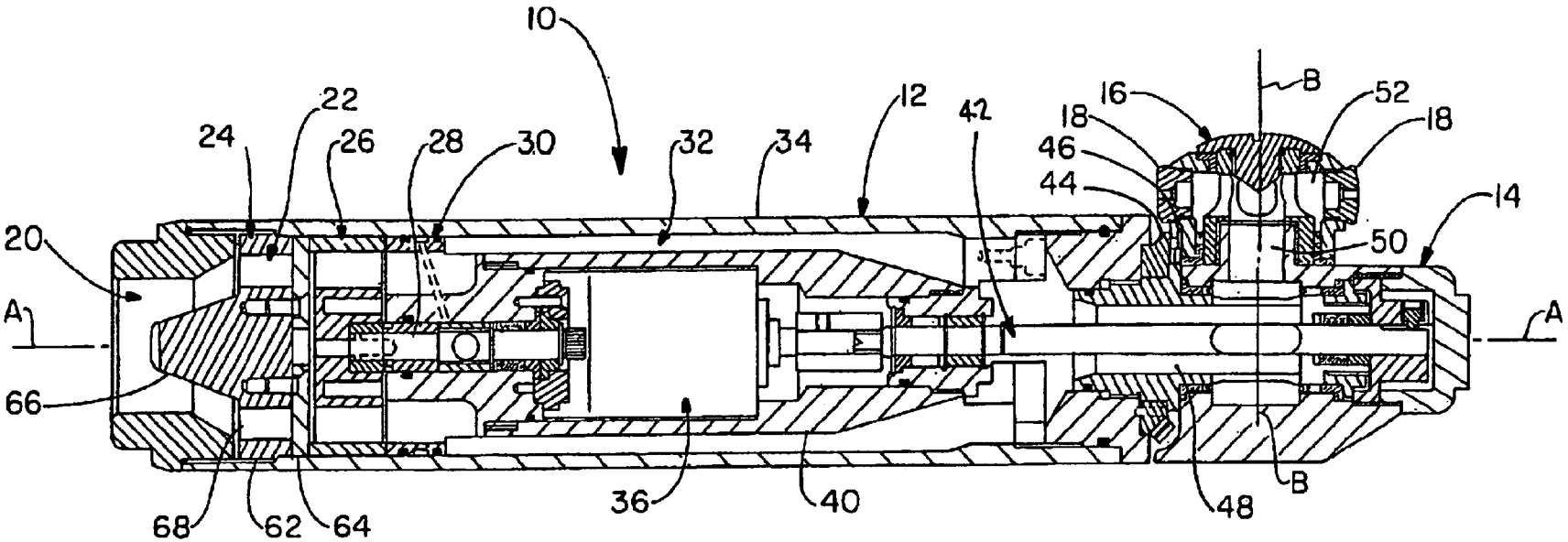
FIG. 1 is a side sectional drawing of the spray cleaner of the present invention.

Reference is made first to FIG. 1, which shows a side sectional view of the spray cleaner 10 of the present invention. This spray cleaner 10 is generally elongate. It has a main body 12 at a first or proximal end of the cleaner 10 and a rotating spray body 14 located at a second or distal end of the cleaner. Additionally, the rotating spray body 14 has at least one spray head 16 mounted thereon, the at least one spray head having a plurality of spray nozzles 18.

The spray cleaner 10 operates in a quite simple manner. The main body 12 is provided with an inlet 20, adapted for connection to a fluid source (not shown). Pressurized fluid from the fluid source enters the cleaner 10 through the inlet 20, where the fluid enters an internal flow conduit 22 This conduit 22 provides a closed communication from the inlet 20 to the spray nozzles 18. In the embodiment illustrated, the pressurized fluid in the conduit 22 of the spray cleaner 10 is forced to pass through an orifice portion 24, which will be described in more detail below. This orifice portion 24, which is removably inserted into the main body, allows the direction area and flow path available to the pressurized fluid to be controlled without affecting the volumetric flow rate through the cleaner 10. Immediately beyond the orifice portion 24, and again in the conduit, is a vaned rotor assembly 26. As the pressurized fluid in the conduit 22 passes through the rotor assembly 26, it imparts torque to a shaft 28, which constitutes a first portion of a drive train 30. This drive train 30 is mounted inside the main body 12, towards the first or proximal end of the cleaner 10. Because the drive train 30 is so proximally located, the pressurized fluid in the conduit 22 passes around the drive train in an annular passage 32 coaxial with the drive train, between the drive train and the wall 34 of the main body. In this manner, the cooling effect of the flowing fluid in the conduit can remove frictional heat generated in the drive train 30. The drive train 30 also contains a multi-stage planetary gear set, shown generally as 36. This planetary gear set 36 has a ring gear (not specifically shown) fixed to a body 40 which ultimately is fixed to the main body 12. The planetary gear set 36 receives drive torque through the shaft 28. The planetary gear set 36 transfers the torque, at a reduced speed, to an output drive system 42. This output drive system 42 is fixedly connected to the rotating spray body 14, so the rotation of drive system 42 relative to main body 12 results in rotation of the rotating spray body 14 relative to the main body. The rotation of the spray body 14 occurs about a longitudinal axis A of the spray cleaner 10. This rotation, in conjunction with additional rotation described below, permits the nozzles 18 to reach the entire interior surface of a vessel being cleaned.

Focusing further on details of the rotating spray body 14, the spray head 16 is mounted in a manner so that it may rotate about an axis B, which is effectively radial to the axis A of the cleaner 10. This rotation is accomplished by the interaction of bevel gears 44, 46. Bevel gear 44 is fixed to the main body and bevel gear 46 is fixed to the spray head 16. When spray body 14 rotates relative to main body 12 due to the torque from the pressurized fluid flow, the meshing of bevel gears 44, 46 results in rotation of spray head 16. When the rotation of spray body 14 and spray head 16 are combined, the spray nozzles 18, two of which are shown in FIG. 1, disperse pressurized fluid throughout the entire vessel being cleaned. In some prior art embodiments, the spray head 16 has been positioned more centrally along length of the cleaner 10, but a problem with such a medial positioning is that the longitudinal body of the cleaner, including both the main body and the distal portions thereof, can block the spray emerging from nozzles 18.

In order for the pressurized fluid to flow from annular passage 32 to the nozzles 18, it is necessary to provide additional portions of the internal flow conduit 22 in both main body 12 and spray body 14. For example, portions of that conduit are shown in FIG. 1 as reference numerals 48, 50 and 52. The internal flow conduit 22 will be provided with appropriate seals connecting the various portions, taking into consideration the pressure and compositions of the pressurized fluid. Such sealing techniques will be well known to one of skill in this art.

Figure 2:
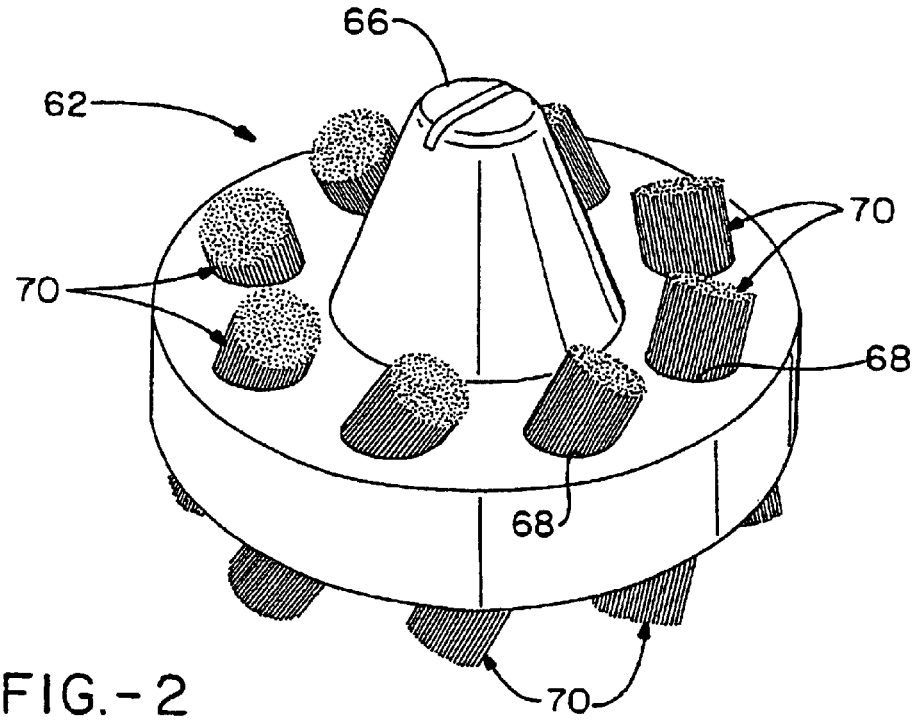
FIG. 2 is an enlarged isometric view of the flow divider of the present invention, isolated from the spray cleaner.
Figure 3:
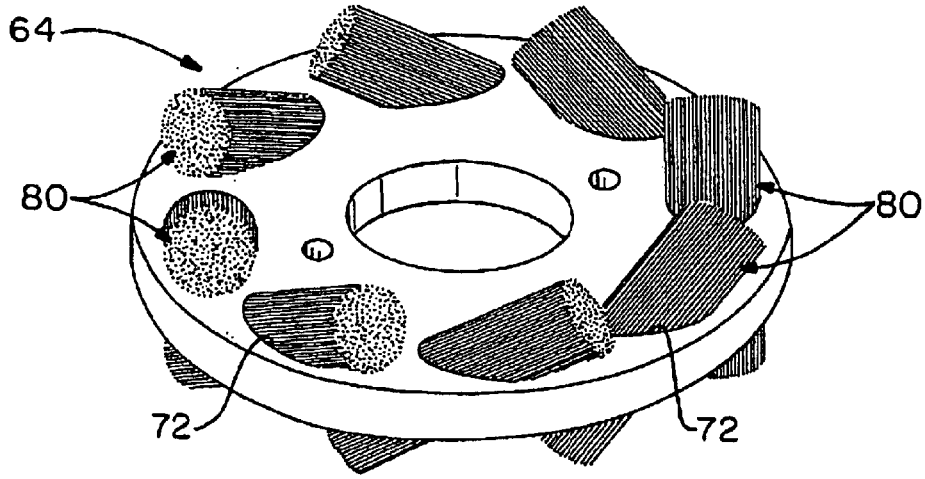
FIG. 3 is an enlarged isometric view of the stator of the present invention, isolated from the spray cleaner.
Figure 4:
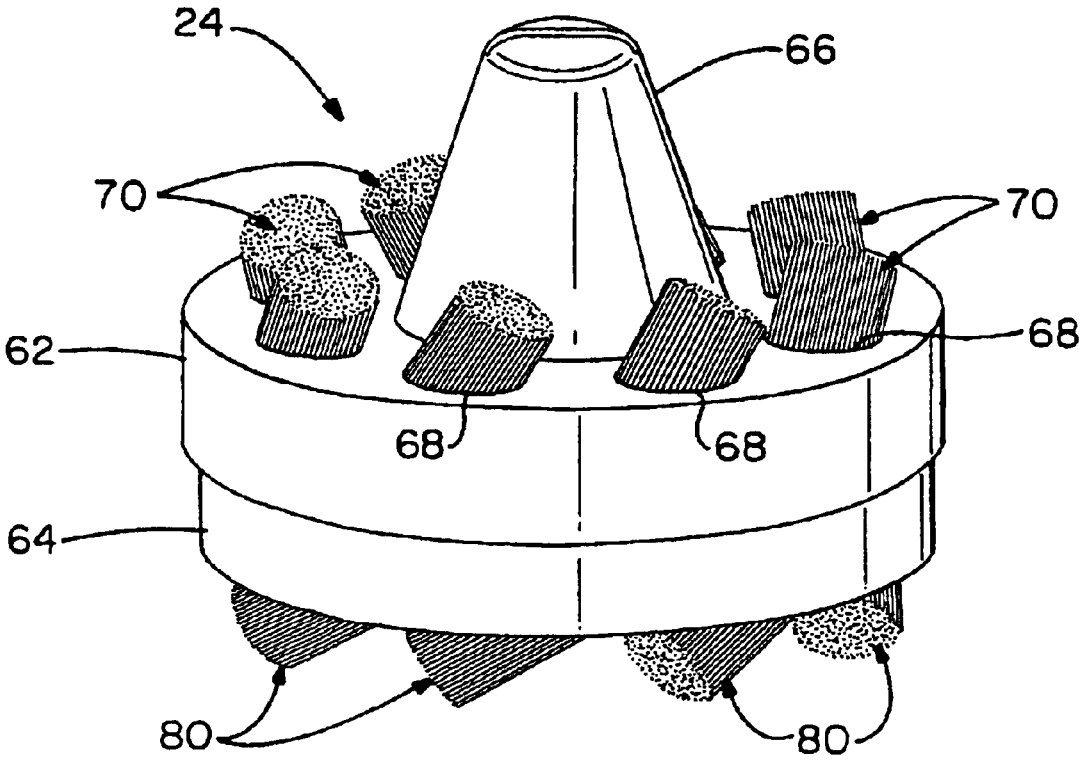
FIG. 4 is an enlarged isometric view of the assembled orifice portion of the present invention, isolated from the spray cleaner.

Attention is focused now on FIGS. 2 through 4, which show the orifice portion 24 in enlarged isolation view, with a representation of the fluid flow therethrough illustrated. This orifice portion 24 comprises two elements: a flow divider 62 and a stator 64. FIG. 2 shows the flow divider 62 in isolation with streams 70 of pressurized fluid illustrated. Upstream of flow divider 62, the pressurized fluid has an available flow area effectively equal to the area defined by the circumference of the flow divider. However, the flow divider 62 has two ways to cut down the flow area. First, a conate projection 66 extends into the fluid flow path and reduces the area. Then, a plurality of openings 68 in the flow divider 62 further reduce the area, so that the cross-sectional flow area is now defined by the combined areas of the openings. Cross-sectional flow area in each openings 68 is constant, but the central axes of the flow paths through the flow divider 62 are not aligned with the central axis of the flow divider, so the discharge angle of the pressurized fluid is set as the fluid passes through the flow divider. This angularity divides what was previously an axial velocity into both axial and radial components.

FIG. 3 shows the stator 64, also isolated from the rest of the cleaner 10, but with pressurized fluid flow paths 80 clearly illustrated. In most embodiments anticipated, the openings 72 in the stator 64 will correspond to and be registerable upon the openings 68 in flow divider 62. Further, in these embodiments, the openings 72 in the stator 64 are slightly smaller in cross-sectional area than those in flow divider 62, which allows a final increase in flow velocity and further assists in locating the flow angle relative to the vaned rotor assembly 26. Also, many embodiments of the stator 64 will increase the angularity of flow with respect to the central axis A of the cleaner 10. This principle is best viewed in FIG. 4, which shows flow divider 62 and stator 64 in their proper operating positions. Particularly note the change in the angularity of the fluid flow paths 70, 80.

The adjustments to fluid flow, both in area and angularity, in the orifice portion 24 affect the transfer of kinetic energy in the fluid to mechanical energy in the rotor assembly 26. Since it not desirable to change the rotor assembly 26, the angle of the vanes on the rotor assembly or the speed reduction ratio provided by the planetary gear set 36 in any routine manner, the ability provided by the present invention to change the orifice portion 24 by changing either the flow divider 62, the stator 64, or both, allows an additional aspect of control over the operating speed of the cleaner. Because the orifice portion is positioned so close to the fluid inlet, it is easily interchangeable with alternate orifice portions. As is shown, the orifice portion is seated in the flow conduit effectively transverse to the longitudinal axis of the cleaner.

Further advantages of the present invention over prior art devices will also be recognized by those of ordinary skill and such further advantages also define the scope of the present invention.

What is claimed is:

1. A rotary spray cleaner, comprising:

a main body at a proximal end of said sprayer cleaner, said main body having a fluid inlet;

a rotating spray body at a distal end of said spray cleaner, said rotating spray body further comprising at least one spray head with each said spray head having a plurality of spray nozzles;

a drive train having an input shaft with a vaned rotor connected thereto, the drive train disposed in the main body and comprising a planetary gear set in which the torque from the input shaft is transferred at a reduced speed to an output drive system that is fixedly connected to the rotating spray body;

an internal flow conduit in the main body and the rotating spray body such that the internal flow conduit communicates the fluid inlet to each said spray nozzle; and a removable office positioned in the flow conduit between the fluid inlet and the vaned rotor, the removable orifice comprising a flow divider and a stator, with a conate projection on the flow divider extending into the flow conduit to reduce flow area.

2. The rotary spray cleaner of claim 1 wherein the flow conduit in the main body passes around the drive train in an annular passage.

3. The rotary spray cleaner of claim 2 wherein the annular passage is coaxial with the drive train in the main body.

4. The rotary spray cleaner of claim 1 wherein rotation of the rotating spray body relative to the main body about a longitudinal axis of the cleaner effects rotation of the at least one spray head about a radial axis of the cleaner.

5. The rotary spray cleaner of claim 4 wherein a first bevel gear fixed to the main body meshes with at least one second bevel gear, with one of such second bevel gears fixed to the at least one spray head, resulting in spray head rotation as the spray body rotates relative to the main body.

6. The rotary spray cleaner of claim 1 wherein the flow divider has a plurality of openings to further reduce flow area.

7. The rotary spray cleaner of claim 6 wherein each of the plurality of openings in the flow divider are radially offset from an axis of the flow divider, inducing a radial component to flow velocity.

8. The rotary spray cleaner of claim 7 wherein the stator is positioned after the flow divider in the orifice portion and has a plurality of openings therein.

9. The rotary spray cleaner of claim 8 wherein a total cross-sectional area of the stator openings is smaller than a total cross-sectional area of the flow divider openings.

10. The rotary spray cleaner of claim 9 wherein the stator openings are positioned to direct fluid flowing in the flow conduit at an angle relative to the vaned rotor.

11. The rotary spray cleaner of claim 10 wherein the angularity imposed by the stator openings relative to the vaned rotor is greater than an angularity imposed by the stator openings.

12. A rotary spray cleaner, comprising:

a main body at a proximal end of said spray cleaner, said main body having a fluid inlet and a drive train with a vaned rotor connected to an input shaft of the drive train;

a rotating spray body at a distal end of said spray cleaner, said rotating spray body further comprising at least one spray head with each said spray head having a plurality of spray nozzles;

an internal flow conduit in the main body and the rotating spray body such that the internal flow conduit communicates the fluid inlet to each said spray nozzle;

a removable orifice portion being positioned in the flow conduit between the fluid inlet and the vaned rotor, which is also positioned in the flow conduit, the orifice portion comprising a flow divider and a stator;

a conate portion on the flow divider extending into the flow conduit to reduce flow area;

the flow divider having a plurality of openings to further reduce flow area, with each of the plurality of openings being radially offset from an axis of the flow divider, inducing a radial component to flow velocity.

13. The rotary spray cleaner of claim 12 wherein the stator is positioned after the flow divider in the orifice portion and has a plurality of openings therein.

14. The rotary spray cleaner of claim 13 wherein a total cross-sectional area of the stator openings is smaller than a total cross-sectional area of the flow divider openings.

15. The rotary spray cleaner of claim 14 wherein the stator openings are positioned to direct fluid flowing in the flow conduit at an angle relative to the vaned rotor.

16. The rotary spray cleaner of claim 15 wherein the angularity imposed by the stator openings relative to the vaned rotor is greater than an angularity imposed by the stator openings.

17. The rotary spray cleaner of claim 12 wherein the flow conduit in the main body passes around the drive train in an annular passage.

18. The rotary spray cleaner of claim 17 wherein the annular passage is coaxial with the drive train in the main body.

19. The rotary spray cleaner of claim 12 wherein rotation of the rotating spray body relative to the main body about a longitudinal axis of the cleaner effects rotation of the at least one spray head about a radial axis of the cleaner.

20. A rotary spray cleaner, comprising:

a main body at a proximal end of said spray cleaner, said main body having a fluid inlet;

a rotating spray body at a distal end of said spray cleaner, said rotating spray body further comprising at least one spray head with each said spray head having at least one spray nozzle;

a drive train having an input shaft with a vaned rotor connected thereto, the drive train disposed in the main body and comprising a planetary gear set in which the torque from the input shaft is transferred at a reduced speed to an output drive system that is fixedly connected to the rotating spray body;

an internal flow conduit in the main body and the rotating spray body such that the internal flow conduit communicates the fluid inlet to each said spray nozzle; and a removable orifice positioned in the flow conduit between the fluid inlet and the vaned rotor, the removable orifice comprising a flow divider and a stator, the stator being positioned after the flow divider, the stator and flow divider each having a plurality of openings therein, with a total cross-sectional area of the stator openings being smaller than a total cross-sectional area of the flow divider openings.

21. The rotary spray cleaner of claim 20 wherein the stator openings are positioned to direct fluid flowing in the flow conduit at an angle relative to the vaned rotor.

22. The rotary spray cleaner of claim 20, wherein the openings in the flow divider define a flow path therethrough that is angularly offset from a central axis of the vaned rotor.

23. The rotary spray cleaner of claim 22 wherein the openings in the stator define a flow path therethrough with an angularity relative to the central axis of the vaned rotor that is greater than that imposed by the fluid divider.

* * * * *

UNITED STATES PATENT AND TRADEMARK OFFICE

CERTIFICATE OF CORRECTION

PATENT NO. : 6,988,676 B2
DATED : January 24, 2006
INVENTOR(S) : Ivan Schreur et al.

It is certified that error appears in the above-identified patent and that said Letters Patent is hereby corrected as shown below:

Title page,
Item [86], § 371 (c)(1), (2), (4) Date, delete "Aug. 14, 2001" and replace with -- Aug. 14, 2002 --.

Signed and Sealed this

Twenty-first Day of March, 2006

JON W. DUDAS
*Director of the United States Patent and Trademark Office*